US009427754B2

(12) United States Patent
Kuroda et al.

(10) Patent No.: US 9,427,754 B2
(45) Date of Patent: Aug. 30, 2016

(54) ROTARY ATOMIZER

(71) Applicant: Ransburg Industrial Finishing K.K., Kanagawa (JP)

(72) Inventors: Masayuki Kuroda, Kanagawa (JP); Kenji Nagato, Kanagawa (JP)

(73) Assignee: RANSBURG INDUSTRIAL FINISHING K.K., Yokohama-Shi, Kanagawa (JP)

( * ) Notice: Subject to any disclaimer, the term of this patent is extended or adjusted under 35 U.S.C. 154(b) by 45 days.

(21) Appl. No.: 14/158,564

(22) Filed: Jan. 17, 2014

(65) Prior Publication Data

US 2014/0131478 A1 May 15, 2014

Related U.S. Application Data

(63) Continuation of application No. 12/598,589, filed as application No. PCT/JP2007/059803 on May 2, 2007, now Pat. No. 8,662,416.

(51) Int. Cl.

| | |
|---|---|
| ***B05B 3/10*** | (2006.01) |
| ***B05D 1/02*** | (2006.01) |
| ***B05B 5/04*** | (2006.01) |
| ***B05B 15/02*** | (2006.01) |

(Continued)

(52) U.S. Cl.

CPC ..... *B05B 3/1057* (2013.01); *B05B 3/1064* (2013.01); *B05B 5/04* (2013.01); *B05B 15/02* (2013.01); *B05D 1/02* (2013.01); *B05B 1/3046* (2013.01); *B05B 3/1014* (2013.01); *B05B 5/0407* (2013.01); *B05B 5/0426* (2013.01); *B05B 7/061* (2013.01)

(58) Field of Classification Search

CPC ..... B05B 3/1014; B05B 3/1057; B05D 1/02

See application file for complete search history.

(56) References Cited

U.S. PATENT DOCUMENTS

| | | | | |
|---|---|---|---|---|
| 5,122,192 | A | 6/1992 | Inukai et al. | |
| 5,707,009 | A * | 1/1998 | Schneider | 239/112 |
| 6,010,084 | A * | 1/2000 | Yoshida et al. | 239/703 |

(Continued)

FOREIGN PATENT DOCUMENTS

| | | |
|---|---|---|
| JP | H0544246 U | 6/1993 |
| JP | H0563656 U | 8/1993 |

(Continued)

OTHER PUBLICATIONS

PCT International Search Report and Written Opinion for PCT/JP2007/059803, dated Jun. 26, 2007.

(Continued)

*Primary Examiner* — Ryan Reis

(74) *Attorney, Agent, or Firm* — Fletcher Yoder, PC

(57) ABSTRACT

In a rotary atomizer (10) including a rotating bell (92) secured to a rotating shaft (20*a*) of an air motor (20) held in an atomizer body, the rotating bell having a plurality of orifices (92*a*) for supplying paint to an object to be painted, the rotating bell being rotated to spray the paint toward the object to be painted, the rotary atomizer comprises a paint passage (102*a*) with a paint port (112*c*) at an end thereof fluidly communicating with the orifices of the rotating bell, and a water passage (108) arranged outside of the paint passage and having a water port at an end of the water passage leading to the orifices of the rotating bell. A needle (94) for opening and closing the paint port may be provided.

20 Claims, 6 Drawing Sheets

(51) Int. Cl.
*B05B 1/30* (2006.01)
*B05B 7/06* (2006.01)

(56) References Cited

U.S. PATENT DOCUMENTS 6,179,217 B1 * 1/2001 Yoshida et al. ..... 239/7
7,861,945 B2 * 1/2011 Yasuda et al. ..... 239/112

FOREIGN PATENT DOCUMENTS

JP 06277571 10/1994
JP 08001046 1/1996
JP 2561529 B2 12/1996
JP 2790153 B2 8/1998
JP 2002214123 A 7/2002
JP 3566584 B2 9/2004
JP 2004344889 12/2004
JP 4347036 B2 10/2009

OTHER PUBLICATIONS

Machine translation of Notification of Reasons for Refusal for Japanese Patent Application No. 2009-513933 dated Aug. 24, 2012, 4 pages.

* cited by examiner

ROTARY ATOMIZER

CROSS REFERENCE TO RELATED APPLICATIONS

This application is a continuation of U.S. patent application Ser. No. 12/598,589, entitled "Rotary Atomizer," filed Nov. 2, 2009, which claims priority to and the benefit of PCT Application No. PCT/JP2007/059803 entitled "Rotary Atomizer," filed on May 2, 2007, all of which are herein incorporated by reference in their entirety for all purposes.

BACKGROUND

The present invention relates to a rotary atomizer.

A rotary atomizer includes a rotating bell which is coupled to a rotating shaft of an air motor and has a plurality of orifices and a paint passage for supplying paint from a paint source to the orifices of the rotating bell, thus dispensing the paint through the orifices toward an object to be painted. In a painting operation, when the rotating shaft of the air motor and the rotating bell are rotated, the paint discharged through the orifices flows radially outwardly along a distal end face of the rotating bell, due to the centrifugal force, toward the peripheral edge of the rotating bell, then the paint is sprayed when separating from the peripheral edge of the rotating bell.

BRIEF DESCRIPTION

Recently, water-based paints have often been used instead of solvent-based paints in view of the state and local government regulations concerning environmental issues. A water-based paint, particularly, a quick-drying water-based emulsion paint turns into a gel immediately after the material has come into contact with the air. For example, when thirty minutes have passed after the start of painting operation, paint clots are deposited around the orifices, the distal end face and/or the outer periphery of the rotating bell, which causes a deformed pattern is deformed, which is a problem.

Further, when the supply of paint is stopped for a certain time period, the paint turns into a gel at the distal portion of the paint passage so that its paint port would be clogged.

In view of the above-mentioned problem of the prior art, an object of the present invention is to provide a rotary atomizer capable of avoiding the deposition of paint clots onto the distal end face of the rotating bell.

Further, another object is to provide a rotary atomizer capable of avoiding the clogging of a paint port at the distal portion of a paint passage.

According to the present invention, there is provided a rotary atomizer including a rotating bell secured to a rotating shaft of an air motor held in an atomizer body, the rotating bell defining a plurality of orifices for dispensing paint to an object to be painted, the rotation of the rotating bell atomizing the paint so as to spray the paint toward the object to be painted, the rotary atomizer comprising: a paint passage having a paint port, at a distal end thereof, fluidly communicating with the orifices of the rotating bell; a water passage disposed outside of the paint passage and having a water port, at a distal end of the water passage, fluidly communicating with the orifices of the rotating bell, and the paint and the water being simultaneously dispensed through the orifices of the rotating bell.

According to another aspect of the present invention, there is provided a rotary atomizer including a rotating bell secured to a rotating shaft of an air motor held in an atomizer body, the rotating bell having a plurality of orifices for dispensing paint to an object to be painted, the rotation of the rotating bell atomizing the paint so as to spray the paint toward the object to be painted, the rotary atomizer comprising: a paint passage having a paint port, at a distal end thereof, fluidly communicating with the orifices of the rotating bell; and a needle for opening and closing the paint port.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

With reference to the drawings, an embodiment of the present invention will be described below.

Figure 1:
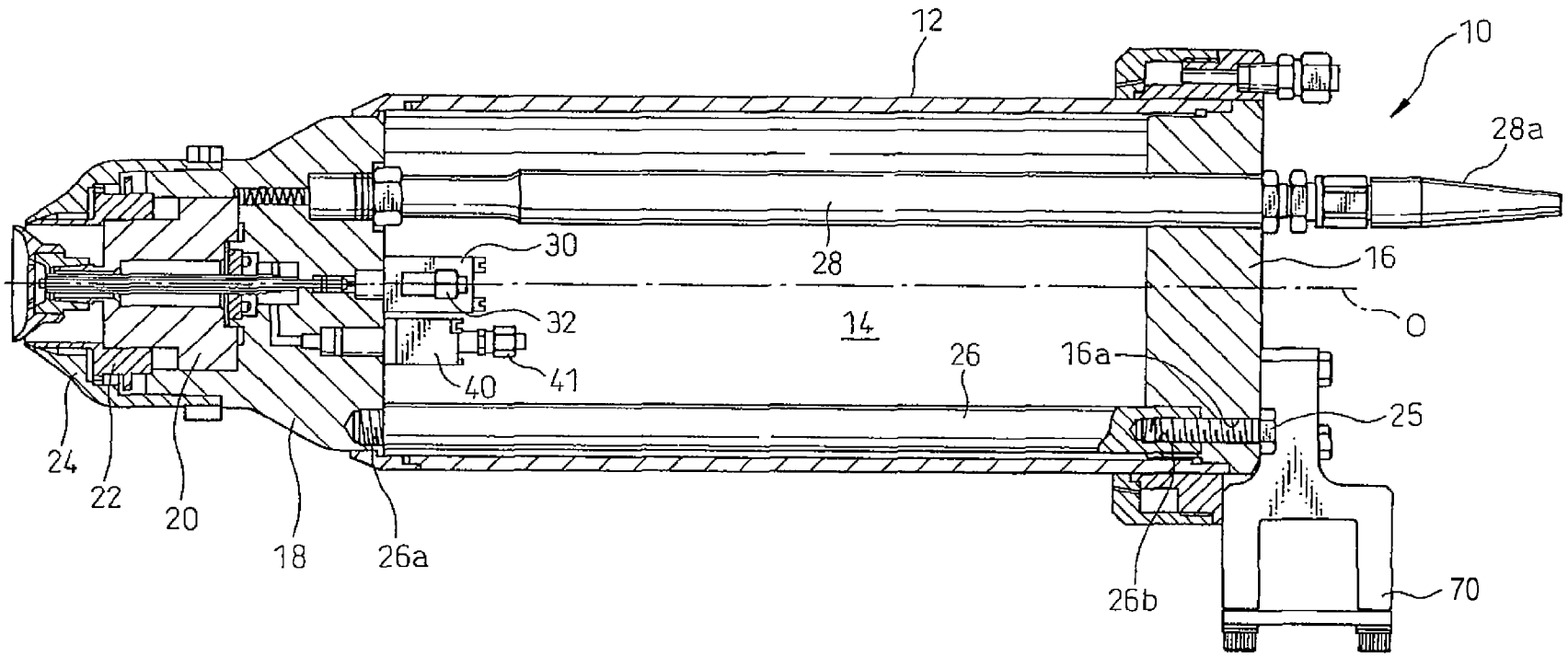
FIG. 1 is a cross-sectional view illustrating a rotary atomizer taken along its axis in accordance with a preferable embodiment of the present invention.
Figure 2:
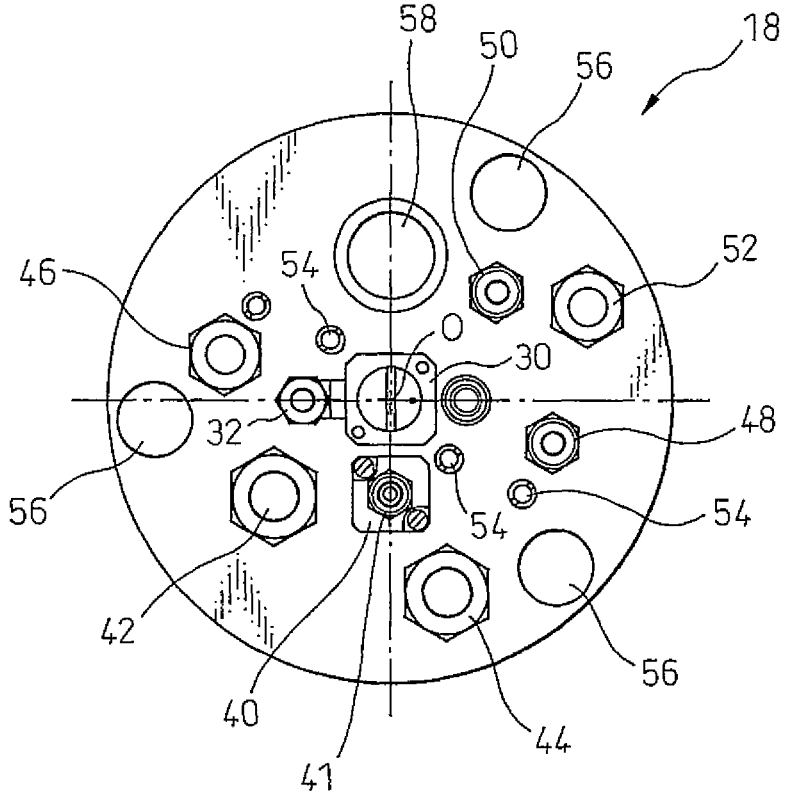
FIG. 2 is a plan view of the rear end face of the manifold of the rotary atomizer.
Figure 3:
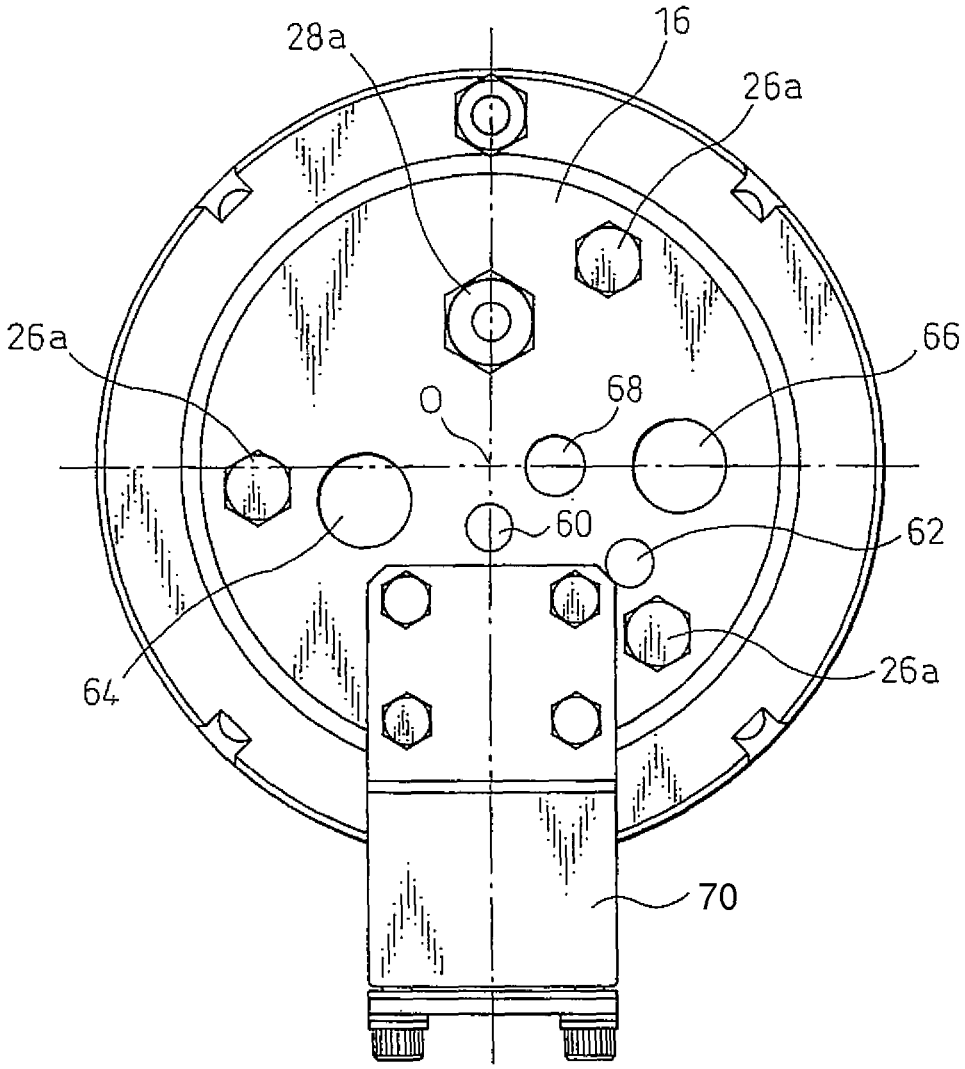
FIG. 3 is an end view of the rotary atomizer showing a rear end face thereof.

Referring to FIG. 1, a rotary atomizer 10 is provided with an atomizer body formed by a cylindrical cover 12, an end plate 16 closing a rear end opening of the cylindrical cover 12, and a manifold 18 mounted on a distal end opening portion opposite to the end plate 16, with an axis O of the cylindrical cover 12 defining a longitudinal axis of the atomizer body. Formed on a rear end face of the manifold 18 (FIG. 2) are three screw holes 56 which are equidistantly provided on the periphery direction around the axis O.

The end plate 16 defines through holes 16*a* which are axially aligned with the screw holes 56 of the manifold 18. Further, within an internal space 14 of the atomizer body, three stays 26 extend parallel to the axis O. The stays 26 define, at the distal ends thereof, screw portions 26*a* which engages with the screw holes 56 of the manifold 18, and at the rear ends thereof, screw holes 26*b* which receive and engage with screw bolts 25. Thus, the manifold 18, the stays 26, the cylindrical cover 12 and the end plate 16 are assembled as illustrated in FIG. 1, and then, the screw bolts 25 are engaged and tightened with the screw holes 26 to unify the manifold 18, the cylindrical cover 12 and the end plate 16.

Further, the rear end face of the manifold 18 includes a screw hole 18*a* engaging with a screw portion 28*a* at the end of a high voltage cable 28 for supplying a voltage to the rotary atomizer 10 to generate an electric field between the rotary atomizer 10 and the object to be painted. The rear end face further includes a first valve receptacle 18*b* for receiving a trigger valve 30, described below, a second valve receptacle 18*c* for receiving a gate valve 40, described below, and a plurality of exhaust ports 54. Further, a paint coupling 42, a water coupling 44, a turbine air coupling 46, a bearing air coupling 48, a brake air coupling 50 and a shaping air coupling 52 are attached to the rear end face of the manifold 18 by using a coupling method well-known in the art such as a screw coupling.

The end plate 16 defines a paint hole 60 and a water hole 62 through which a paint tube 218 (FIG. 6) for supplying paint to the paint coupling 42 from a paint source, described below, and a water tube 220 (FIG. 6) for supplying water to the water coupling 44 from a water source, described below, are introduced into the internal space 14. Further, air holes 64 and 66 and an exhaust port 68 are formed in the end plate 16. Through the air holes, a plurality of air tubes 206-216 (FIG. 6), for respectively supplying air from an air source, described below, to the turbine air coupling 46, the bearing air coupling 48, the brake air coupling 50 and the shaping air coupling 52, are introduced into the internal space 14. Reference numeral 70 designates a bracket for mounting the rotary atomizer 10 on a stand (not shown) or a robot hand (not shown).

The first valve receptacle 18*b* is a recess formed along the axis O in which the trigger valve 30 is accommodated. Further, a paint chamber 78 adjacent the first valve receptacle 18*a* opens into the end or bottom of the first valve receptacle 18*b*.

Further, a needle passage 80 fluidly connected to the paint chamber 78 in the manifold 18. The end of the needle passage 80 opposite to the paint chamber 78 opens into a pocket 88 which opens into a stopper receptacle 89. The stopper receptacle 89 opens into a motor receptacle 74 formed at the distal end of the manifold 18.

As stated above, the paint chamber 78 is a recess extending along the axis where one end opens into the first valve receptacle 18*b* and the opposite end opens into the pocket 88. A passage 82, fluidly communicating with the paint coupling 42, opens into the side wall of the recess. In this embodiment, the passage 82, the paint chamber 78 and the needle passage 80 provide a paint supplying passage.

The second valve receptacle 18*c* is an axially extending recess which is offset in the radial direction from the first valve receptacle 18*b*. The gate valve 40 is held in the second valve receptacle 18*c*. At a distal end portion of 40*a*, the outer surface of the gate valve 40 defines a peripheral groove 40*b* which opens into a radial passage 40*c*. The radial passage 40*c* is fluidly connected to an axially extending internal passage (not shown) of the end portion 40*a*.

Further, the gate valve comprises an axially reciprocating valve body 40*d*, for opening and closing the internal passage of the end portion 40*a*, and a coupling 41 for receiving air to activate the valve body 40*d*. Further, a passage 84, fluidly connected to the water coupling 44, opens into the side wall of the second valve receptacle 18*c*. Furthermore, the second valve receptacle 18*c* is fluidly connected via the passage 86 to the pocket 88.

A substantially cylindrical confluence member 90 is provided in the pocket 88.

The confluence member 90 includes a peripheral groove 90*a* formed in its outer surface, a central through hole 90*b* and a radial passage 90*c* extending between the central through hole 90*b* and the peripheral groove 90*a*. The passage 86 extending from the second valve receptacle 18*c* is positioned at the side wall of the pocket 88 so that the passage 86 opens into the peripheral groove 90*a* of the confluence member 90. In this embodiment, the passage 84, the peripheral groove 40*b*, the radial passage 40*c*, the internal passage of the end portion 40*a*, the passage 86, the peripheral groove 90*a*, the radial passage 90*c* and the central through hole 90*b* provide a water supplying passage.

Accommodated in the air motor receptacle 74 is an air motor 20 having a rotating shaft 20*a* extending along the axis O. A rotating bell 92 is secured to the rotating shaft 20*a* of the air motor 20. The air motor 20 incorporates a turbine (not shown) coupled to the rotating shaft 20*a* and driven by turbine air, as described below.

Figure 5:
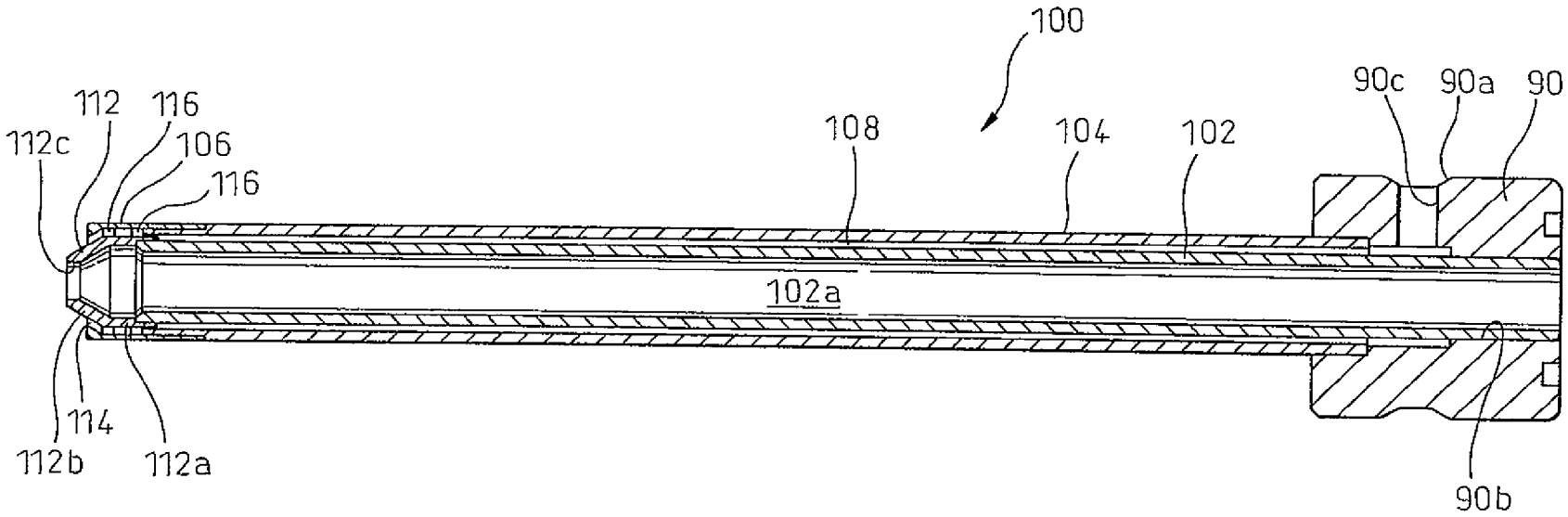
FIG. 5 is a sectional view of the dual-tube assembly taken along its axis.

A dual-tube assembly 100 extends through the body portion and the rotating shaft 20*a* of the air motor 20 along the axis O. Referring to FIG. 5, the dual-tube assembly 100 comprises an inner tube 102 defining an inner passage 102*a* which provides a paint passage, an outer tube 104 having an inner diameter larger than the outer diameter of the inner tube 102, a tip member 112 attached to the distal end of the inner tube 102 and a sleeve 106 attached to the distal end of the outer tube 104.

The inner tube 102, the outer tube 104, the tip member 112 and the sleeve 106 are concentrically disposed around the axis O so that an annular outer passage 108 is defined between the inner tube 102 and the outer tube 104 to provide a water passage. At the rear end of the dual-tube assembly 100, the outer passage 108 is attached to the confluence member 90 so that the outer passage 108 is fluidly connected via the central through hole 90*b* of the confluence member 90 to the radial passage 90*c*.

The tip member 112 has an annular proximal end portion 112*a* and a tapered portion 112*b* coupled to the proximal end portion 112*a*. The tapered portion has a diameter gradually decreased toward the distal end and defines a paint port 112*c* fluidly connected to the inner passage 102. An inner surface of the tapered portion 112*b*, converging toward the distal end, provides a valve seat which sealingly contacts with a valve body 94*a*, described below. Further, in order to maintain the radial position of the sleeve 106 with respect to the tip member 112, a ring member 116 with a plurality of axial orifices (not shown) is arranged between the tip member 112 and the sleeve 106. Thus, an annular water port 114 is defined between the tip member 112 and the sleeve 106.

The trigger valve 30 comprises a pneumatically reciprocating valve stem 30*a* along the axis O and a coupling 32 which receives air for driving the valve stem 30*a*. Coupled to the distal end of the valve stem 30*a* is a needle 94 extending along the axis O and defining a valve body 94*a* at the distal end thereof. Thus, the needle 94 extends along the axis O from the valve stem 30*a* via the paint chamber 78, the needle passage 80 and the inner tube 102 of the dual-tube assembly 100 to the valve body 94*a*.

A rotating bell 92*b* is mounted to the rotating shaft 20*a* of the air motor 20. The rotating bell 92*b* includes, as well known in the art, a bell-shaped or cup-shaped distal end face 92*b* and a plurality of orifices 92*a* opening into the distal end face 92*b*.

Mounted on the distal end of the manifold 18 are an inner ring 22 enclosing the air motor 20 and an outer ring 24 arranged concentrically with the inner ring 22. A shaping air passage 23, fluidly connected to the shaping air coupling 52, is defined between the inner ring 22 and the outer ring 24.

Figure 6:
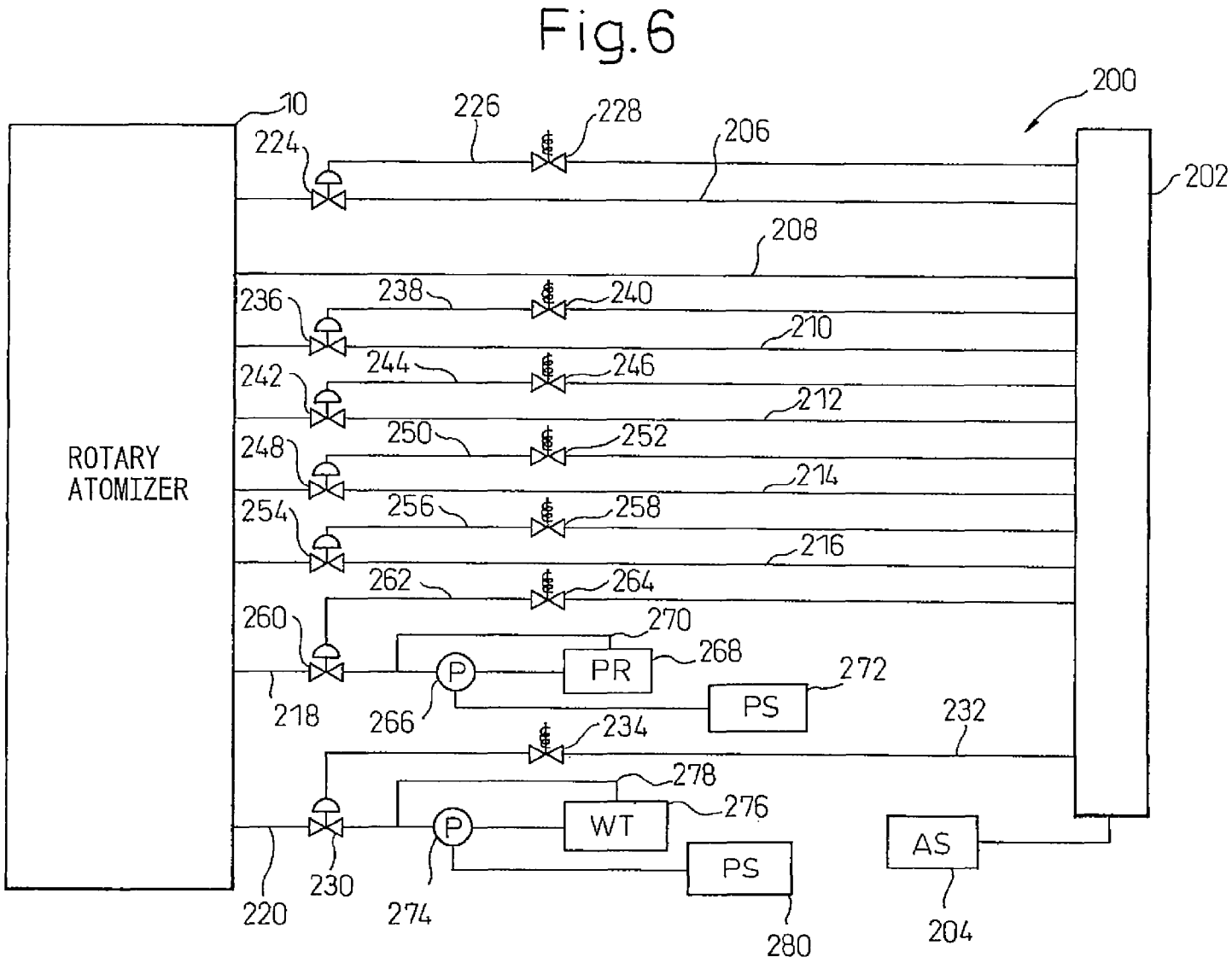
FIG. 6 is a block diagram of a preferable embodiment of a painting system suitable for incorporating with the rotary atomizer of the present invention.

With reference to FIG. 6, a painting system which is suitable for incorporating with the rotary atomizer of the present invention will be described below. A painting system 200 comprises a compressor 204 providing an air source (AS), a header 202 fluidly connected to an outlet port of the compressor 204, a turbine air tube 206 for supplying turbine air to the turbine air coupling 46 to drive the air motor, a bearing air tube 208 for supplying bearing air to the bearing air coupling 48 to suspend the rotating shaft 20*a*, a brake air tube 210 for supplying brake air to the brake air coupling 50 to reversely rotate the rotating shaft 20*a*, a shaping air tube 212 for supplying shaping air to the shaping air coupling 52 to control the spray pattern, a first valve driving air tube 214 for supplying air to the coupling 32 of the trigger valve 30 to rearwardly drive the valve stem 30*a* along the axis O, a second valve driving air tube 216 for supplying air to the coupling 41 of the gate valve 40 to drive the valve body 40*d*, a paint tube 218 for supplying paint to the paint coupling 42 and a water tube 220 for supplying water to the water coupling 44.

Provided on the turbine air tube 206 is a pneumatically-operating normally-closed ON/OFF valve 224 for controlling the supplying and shutting-off of turbine air. The opening and closing of the ON/OFF valve 224 is controlled by opening and closing a solenoid valve 228 provided on a control air tube 226. The bearing air tube 208 is continuously opened so that bearing air is continuously supplied to the air motor 20 from the activation to the shutoff of the compressor 204.

Provided on the brake air tube 210 is a pneumatically-operating normally-closed ON/OFF valve 236 for controlling the supplying and shutting-off of brake air. The opening and closing of the ON/OFF valve 236 is controlled by opening and closing a solenoid valve 240 provided on a control air tube 238.

Provided on the shaping air tube 212 is a pneumatically-operating normally-closed ON/OFF valve 242 for controlling the supplying and shutting-off of shaping air. The opening and closing of the ON/OFF valve 242 is controlled by opening and closing a solenoid valve 246 provided on a control air tube 244.

Provided on the first valve driving air tube 214 is a pneumatically-operating normally-closed ON/OFF valve 248 for controlling the supplying and shutting-off of air for driving the valve stem 30*a*. The opening and closing of the ON/OFF valve 248 is controlled by opening and closing a solenoid valve 252 provided on a control air tube 250.

Provided on the second valve driving air tube 216 is a pneumatically-operating normally-closed ON/OFF valve 254 for controlling the supplying and shutting-off of air for driving the valve stem 40*d*. The opening and closing of the ON/OFF valve 254 is controlled by opening and closing a solenoid valve 258 provided on a control air tube 256.

Paint is supplied by a paint pump 266 from a paint reservoir 268 via a paint tube 218 to the rotary atomizer 10. Provided on the paint tube 218 are a pneumatically-operating normally-closed ON/OFF valve 260 for controlling the supplying and shutting-off of paint and a circulation tube 268 for returning paint discharged from the paint pump 266 to the paint reservoir 268 when the ON/OFF valve 260 is closed. The opening and closing of the ON/OFF valve 260 is controlled by opening and closing a solenoid valve 264 provided on a control air tube 262. A power supply unit 272 supplies electrical power to the paint pump 266.

Water is supplied by a water pump 274 from a water tank 276 via a water tube 220 to the rotary atomizer 10. Provided on the water tube 220 are a pneumatically-operating normally-closed ON/OFF valve 230 for controlling the supplying and shutting-off of water and a circulation tube 278 for returning water discharged from the water pump 274 to the water tank 276 when the ON/OFF valve 230 is closed. The opening and closing of the ON/OFF valve 230 is controlled by opening and closing a solenoid valve 234 provided on a control air tube 232. A power supply unit 280 supplies electrical power to the water pump 274.

Herein after, the operation of the present embodiment will be described below.

In advance of starting a painting operation, the compressor 204, the paint pump 266 and the water pump 274 are activated. When the compressor 204 is activated, bearing air is supplied from header 202 via the bearing air tube 208 and the bearing air coupling 218 to the air motor 20 so that the rotating shaft 20*a* of the air motor 20 is suspended.

Next, when the ON/OFF valve 224 is opened, turbine air is supplied from the header 202 via the turbine air tube 206 and the turbine air coupling 46 to the air motor 20, to thereby rotate the rotating shaft 20*a* and the rotating bell 92 secured to the rotating shaft 20*a*. Next, when the ON/OFF valve 242 is opened, shaping air is supplied from the header 202 via the shaping air tube 206 and the shaping air coupling 32 to the shaping air passage 23 so that shaping air is discharged through the shaping air port 23*a* between the distal ends of the inner ring 22 and the out ring 24. In this connection, the supply of shaping air can be started at the same time as the supply of turbine air.

Figure 4:
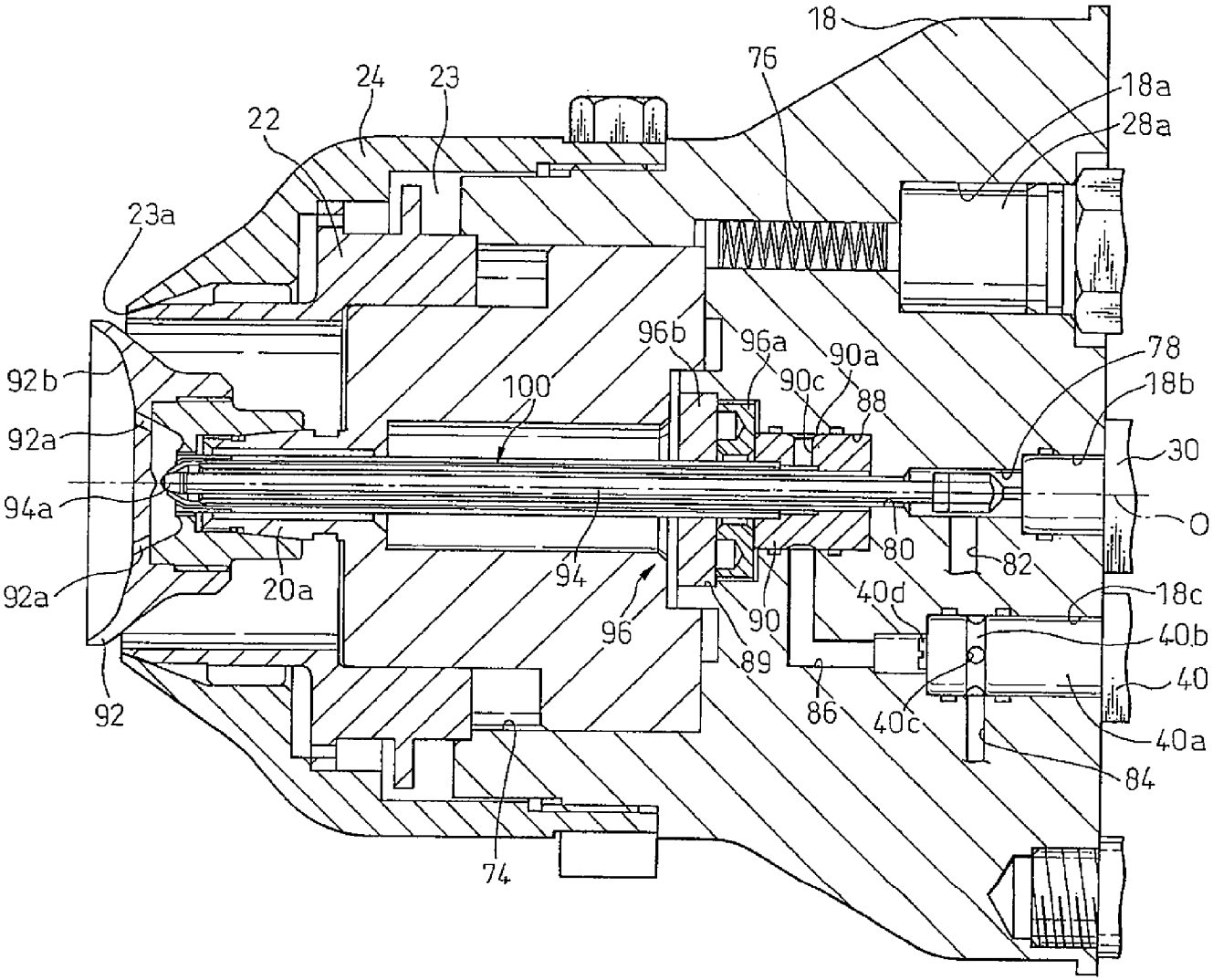
FIG. 4 is a partial section of the front part of the rotary atomizer.

Water is supplied from the water tank 274 via the water tube 220 to the water coupling 44. Simultaneously, when the ON/OFF valve 254 of the second valve driving air tube 216 is opened, air is supplied from the header 202 via the second valve driving air tube 216 and the coupling 41 of the gate valve 40 to the gate valve 40, so that the valve body 40*d* thereof is forwardly driven, i.e., moved in the left direction in FIGS. 1 and 4. Thus, together with paint, water is discharged from the orifices 92*a* of the rotating bell 92 via the water coupling 44, the passage 84, the peripheral groove 90*a*, the radial passage 90*c* and the central through hole 90*b* of the confluence member 90, the outer passage 108 of the dual-tube assembly 100 and the water port 114. In particular, the water discharged through the orifices 92*a* flows outwardly in the radial direction of the rotating bell 92 between the paint discharged through the orifices 92*a* and the distal end faces 92*b* of the rotating bell 92.

When the ON/OFF valve 260 is opened, paint is supplied from the paint reservoir 268 via the paint tube 218 to the paint coupling 42. Further, when the ON/OFF valve 248 of the first valve driving air is opened, air is supplied from the header 202 via the first valve driving air tube 214 and the trigger valve 30 to the trigger valve 30 so that the valve stem 30*a* thereof is backwardly driven, i.e., moved in the right direction in FIGS. 1 and 4. Thus, the valve body 94*a* is disengaged from the inner surface of the tapered portion 112*b* of the tip member 112 providing a valve seat so that the paint port 112*c* is opened. Thus, paint is discharged through the orifices 92*a* via the paint coupling 42, the passage 82, the paint chamber 78, the needle passage 80 the inner passage 102*a* of the dual-tube assembly 100 and the paint port 112*c* of the tip member 112.

Note that the air motor 20 can be of a two speed type where the speed is increased when paint is supplied.

In the above-described embodiment, a water film is formed between the paint discharged through the orifices 92*a* and the distal end face 92*b* of the rotating bell 92, which would prevent paint clots from depositing on the distal end face 92*b* of the rotating bell 92.

Further, in a non-painting operation, since the paint port 112*c* is closed by the valve body 94*a* of the needle 94, the clogging of the paint port 112*c* in the prior art can be avoided.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A rotary atomizer, comprising:

a rotary bell secured to a rotary shaft of an air motor held in an atomizer body, the rotary bell defining a plurality of orifices for dispensing a paint toward an object to be painted, wherein the rotary bell is configured to rotate to atomize the paint so as to spray the paint toward the object to be painted;

a paint passage having a paint port, at a distal end thereof, fluidly communicating with the orifices of the rotary bell;

a water passage, disposed outside of the paint passage, having a water port, at a distal end thereof, fluidly communicating with the orifices of the rotary bell;

a water supply coupling coupled to the water passage and configured to supply water to the water passage, wherein the water supply coupling comprises an opening configured to fluidly couple to a water source; and the plurality of orifices are configured to dispense the paint and water simultaneously.

2. The rotary atomizer according to claim 1, wherein the paint passage has a circular section about a longitudinal axis of the rotary shaft of the air motor; and the water passage has a circular section concentric with that of the paint passage.

3. The rotary atomizer according to claim 1, comprising a needle for opening and closing the paint port at the distal end of the paint passage.

4. The rotary atomizer according to claim 1, comprising:

a manifold defining a paint supply passage, an air supply passage and a supply water passage;

the air motor held in a front part of the manifold, the air motor having the rotary shaft rotatable about a predetermined axis, the rotary shaft being rotationally driven by air supplied through the air supply passage;

a double tube assembly including an inner tube extending through the rotary shaft along the axis and a concentric outer tube having a inner diameter larger than the outer diameter of the inner tube, the outer tube extending through the rotary shaft along the axis so as to define a passage between an outer surface of the inner tube and an inner surface of the outer tube;

the rotary bell secured to the rotary shaft to rotate therewith, and defining the plurality of orifices for dispensing the paint toward the object to be painted;

the inner tube of the double tube assembly fluidly communicating with the paint supply passage of the manifold and the orifices of the rotary bell; and the passage between the inner and outer tubes of the double tube assembly fluidly communicating with the water supply passage of the manifold and the orifices of the rotary bell.

5. The rotary atomizer according to claim 1, wherein the rotary atomizer comprises:

a manifold defining a paint supply passage, an air supply passage and a supply water passage;

the air motor held in a front part of the manifold, the air motor having the rotary shaft rotatable about a predetermined axis, the rotary shaft being rotationally driven by air supplied through the air supply passage;

a double tube assembly including an inner tube extending through the rotary shaft along the axis and a concentric outer tube having a inner diameter larger than the outer diameter of the inner tube, the outer tube extending through the rotary shaft along the axis so as to define a passage between an outer surface of the inner tube and an inner surface of the outer tube;

the rotary bell secured to the rotary shaft to rotate therewith, and defining the plurality of orifices for dispensing the paint toward the object to be painted;

a pneumatic trigger valve attached to the manifold, the trigger valve including a valve stem movable along the axis of the rotary shaft of the air motor between an open position and a closed position, a needle attached to the valve stem and extending through the inner tube of the double tube assembly; and the needle defining a valve body, at the distal end thereof, extendable beyond the distal end of the inner tube of the double tube assembly.

6. The rotary atomizer according to claim 5, wherein the double tube assembly comprises a tip member attached to the distal end of the inner tube, the tip member defining an annular proximal end and a tapered part, attached to the proximal end, converging in the distal direction; and the tapered part defining, at the distal end thereof, the paint port fluidly communicating with the orifices of the rotary bell, the valve body being sealingly engagable with an inner surface of the tapered part and extendable from the paint port.

7. The rotary atomizer according to claim 1, comprising a gate valve coupled to the water supply coupling and the water passage, wherein the gate valve is configured to adjust a flow of the water from the water supply coupling to the water passage.

8. A system, comprising:

a rotary atomizer, comprising:

a rotary bell coupled to a rotary shaft of an air motor disposed in an atomizer body of the rotary atomizer, wherein the rotary bell comprises a plurality of orifices configured to dispense paint toward an object to be painted, wherein the rotary bell is configured to rotate to atomize the paint so as to spray the paint toward the object;

a paint passage comprising a paint port disposed at a paint passage distal end, wherein the paint passage is fluidly coupled to the plurality of orifices;

a water passage disposed outside of the paint passage and comprising a water port disposed at a water passage distal end, wherein the water passage is fluidly coupled to the plurality of orifices, and the plurality of orifices are configured to dispense the paint and water simultaneously; and a water supply coupling coupled to the water passage and configured to supply water to the water passage, wherein the water supply coupling comprises an opening configured to fluidly couple to a water source.

9. The system of claim 8, wherein the paint passage comprises a paint circular cross-section about a longitudinal axis of the rotary shaft, and the water passage comprises a water circular cross-section concentric with the paint circular cross-section.

10. The system of claim 8, wherein the rotary atomizer comprises a needle configured to open and close the paint port.

11. The system of claim 8, wherein the rotary atomizer comprises an air supply passage, the air motor is disposed in a front part of the atomizer body, and the air motor is configured to be driven by air supplied by the air supply passage.

12. The system of claim 8, wherein the water passage concentrically surrounds the paint passage such that an inner diameter of the water passage is greater than an outer diameter of the paint passage.

13. The system of claim 8, wherein the rotary atomizer comprises:

a pneumatic trigger valve comprising a valve stem movable along a longitudinal axis of the rotary shaft between an open position and a closed position; and a needle coupled to the valve stem and extending through the paint passage, wherein the needle comprises a valve body disposed at a valve body distal end and the needle is configured to extend beyond the paint passage distal end.

14. The system of claim 13, wherein the rotary atomizer comprises a tip member coupled to the paint passage distal end, the tip member comprises an annular proximal end and a tapered part coupled to the proximal end and converging in a distal direction, the tapered part comprises the paint port fluidly coupled to the plurality of orifices, and the valve body is configured to be sealingly engagable with an inner surface of the tapered part and extendable from the paint port.

15. A system, comprising:

a rotary atomizer, comprising:

a rotary bell coupled to a rotary shaft of an air motor disposed in an atomizer body of the rotary atomizer, wherein the rotary bell comprises a plurality of orifices configured to dispense paint toward an object to be painted, and the rotary bell is configured to rotate to atomize the paint so as to spray the paint toward the object;

a paint passage comprising a paint port disposed at a paint passage distal end, wherein the paint passage is fluidly coupled to the plurality of orifices, and the paint passage comprises a paint circular cross-section about a longitudinal axis of the rotary shaft;

a water passage disposed outside of the paint passage and comprising a water port disposed at a water passage distal end, wherein the water passage is fluidly coupled to the plurality of orifices, the water passage comprises a water circular cross-section concentric with the paint circular cross-section, and the plurality of orifices are configured to dispense the paint and water simultaneously; and a water supply coupling coupled to the water passage and configured to supply water to the water passage, wherein the water supply coupling comprises an opening configured to fluidly couple to a water source.

16. The system of claim 15, wherein the rotary atomizer comprises a needle configured to open and close the paint port.

17. The system of claim 15, wherein the rotary atomizer comprises an air supply passage, the air motor is disposed in a front part of the atomizer body, and the air motor is configured to be driven by air supplied by the air supply passage.

18. The system of claim 15, wherein the water passage concentrically surrounds the paint passage such that an inner diameter of the water passage is greater than an outer diameter of the paint passage.

19. The system of claim 15, wherein the rotary atomizer comprises:

a pneumatic trigger valve comprising a valve stem movable along a longitudinal axis of the rotary shaft between an open position and a closed position; and a needle coupled to the valve stem and extending through the paint passage, wherein the needle comprises a valve body disposed at a valve body distal end and the needle is configured to extend beyond the paint passage distal end.

20. The system of claim 19, wherein the rotary atomizer comprises a tip member coupled to the paint passage distal end, the tip member comprises an annular proximal end and a tapered part coupled to the proximal end and converging in a distal direction, the tapered part comprises the paint port fluidly coupled to the plurality of orifices, and the valve body is configured to be sealingly engagable with an inner surface of the tapered part and extendable from the paint port.

* * * * *